US010832572B2

(12) United States Patent
Cha et al.

(10) Patent No.: US 10,832,572 B2
(45) Date of Patent: Nov. 10, 2020

(54) VEHICLE ACTUATED SIGNAL CONTROL SYSTEM AND METHOD

(71) Applicants: HYUNDAI MOTOR COMPANY, Seoul (KR); KIA MOTORS CORPORATION, Seoul (KR)

(72) Inventors: Yeon Joo Cha, Suwon-si (KR); In Ho Yoon, Gwangmyeong-si (KR); Su Jin Kwon, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/387,906

(22) Filed: Apr. 18, 2019

(65) Prior Publication Data

US 2019/0244519 A1 Aug. 8, 2019

(30) Foreign Application Priority Data

Nov. 16, 2018 (KR) ..... 10-2018-0142019

(51) Int. Cl.

| | |
|---|---|
| ***G08G 1/07*** | (2006.01) |
| ***G08G 1/08*** | (2006.01) |
| ***G08G 1/082*** | (2006.01) |
| ***G08G 1/087*** | (2006.01) |

(52) U.S. Cl.

CPC ..... *G08G 1/07* (2013.01); *G08G 1/08* (2013.01); *G08G 1/082* (2013.01); *G08G 1/087* (2013.01)

(58) Field of Classification Search

CPC ..... G08G 1/00; G08G 1/07; G08G 1/082; G08G 1/123; G08G 1/127; G08G 1/133; G08G 1/087

See application file for complete search history.

(56) References Cited

U.S. PATENT DOCUMENTS

| | | | | |
|---|---|---|---|---|
| 7,269,502 | B2 * | 9/2007 | Zhang | G08G 1/087 340/907 |
| 7,477,984 | B2 * | 1/2009 | Zhang | G08G 1/087 340/907 |
| 8,878,695 | B2 * | 11/2014 | Cross | G08G 1/082 340/906 |
| 2012/0326891 | A1 * | 12/2012 | Cross | G08G 1/082 340/906 |

* cited by examiner

*Primary Examiner* — Van T Trieu
(74) *Attorney, Agent, or Firm* — Morgan, Lewis & Bockius LLP

(57) ABSTRACT

A system for controlling a vehicle actuated signal includes: a vehicle terminal that transmits actuated signal light information and estimated arrival time information when an actuated signal lane on a travel route is reserved to be used; a telematics server that requests a signal change reservation based on the actuated signal light information and the estimated arrival time information; and a traffic light control server that sets the signal change reservation in response to a request of the telematics server and controls a signal of the actuated signal light based on set reservation information.

20 Claims, 7 Drawing Sheets

VEHICLE ACTUATED SIGNAL CONTROL SYSTEM AND METHOD

CROSS-REFERENCE TO RELATED APPLICATION

This application is claims the benefit of priority to Korean Patent Application No. 10-2018-0142019, filed in the Korean Intellectual Property Office on Nov. 16, 2018, the entire contents of which are incorporated herein by reference.

TECHNICAL FIELD

The present disclosure relates to a system for controlling a vehicle actuated signal and a method thereof.

BACKGROUND

An actuated signal light is a traffic light that detects a vehicle on an actuated signal road by using a vehicle detector (a loop detector) to automatically control a traffic signal. Such an actuated signal light controls the traffic signal according to a vehicle flow, thereby inducing a smooth flow of vehicles.

However, the conventional actuated signal light may not operate smoothly when the vehicle is out of a vehicle detection area of an actuated signal lane.

In addition, since the conventional actuated signal light does not directly change the traffic signal even if the vehicle is properly positioned within the vehicle detection area, the traffic signal may be changed after waiting for a predetermined period of time in the vehicle detection area, so that it is difficult to determine whether the vehicle stopped properly in the detection area in view of a vehicle or a driver.

SUMMARY

The present disclosure has been made to solve the above-mentioned problems occurring in the prior art while advantages achieved by the prior art are maintained intact.

An aspect of the present disclosure provides a vehicle actuated signal control system which supports a signal change reservation of an actuated signal light when it is scheduled that a vehicle passes through an actuated signal lane on a traveling route, and a method thereof.

Another aspect of the present disclosure provides a vehicle actuated signal control system which supports a vehicle to reserve a signal change directly to an actuated signal light when the actuated signal light cannot detect a vehicle, and a method thereof.

Technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a system for controlling a vehicle actuated signal includes: a vehicle terminal that transmits actuated signal light information and estimated arrival time information when an actuated signal lane on a travel route is reserved to be used; a telematics server that requests a signal change reservation based on the actuated signal light information and the estimated arrival time information; and a traffic light control server that sets the signal change reservation in response to a request of the telematics server and controls a signal of an actuated signal light based on set reservation information.

The vehicle terminal may include a vehicle speed sensor that measures a vehicle speed, a camera that obtains an image of vehicle surroundings, and a processor that determines whether a vehicle is located in a detection area of an actuated signal lane through the vehicle speed sensor and the camera when the signal change reservation is not possible.

The vehicle terminal may further include an inductance sensor installed a lower end of the vehicle to detect whether a vehicle detector installed on the actuated signal lane is operated.

The vehicle detector may include a loop coil to detect whether the vehicle is in the detection area.

The inductance sensor may detect a change in inductance of the loop coil.

The processor may determine that the vehicle is in the detection area by determining that the vehicle detector is in operation when the change in inductance of the loop coil is detected.

The processor may directly request a traffic signal controller configured to control an operation of the actuated signal light to change a signal by determining that the vehicle detector is not in operation when the change in inductance of the loop coil is not detected.

The traffic signal controller may feedback signal change time information to the vehicle terminal when the vehicle detector detects that the vehicle is in the detection area.

The processor may obtain the actuated signal light information by using global positioning system (GPS) information and a precise map.

According to another aspect of the present disclosure, a method of controlling a vehicle actuated signal includes steps of: confirming, by a vehicle terminal, whether an actuated signal lane on a traveling route is to be used; transmitting, by the vehicle terminal, information about the actuated signal lane to be used and estimated arrival time information to a telematics server when the actuated signal lane on the traveling route is reserved to be used; requesting, by the telematics server, a traffic light control server to reserve a signal change based on the actuated signal light information and the estimated arrival time information; and reserving, by the traffic light control server, the signal change in response to the request of the telematics server, and changing a signal of the actuated signal light based on reservation information.

The confirming of the reservation of using the actuated signal light may include confirming, by the vehicle terminal, whether the actuated signal lane is reserved to be used at a time when a time condition set based on the traveling route is met.

The method may further include determining, by the vehicle terminal, whether reserving the signal change is possible by confirming whether wireless communication with the telematics server is possible before the transmitting of the actuated signal light information and the estimated arrival time information to the telematics server.

The determining of whether reserving the signal change is possible may include confirming, by the vehicle terminal, whether a vehicle speed decelerates to less than a reference speed when the signal change reservation is impossible, obtaining, by the vehicle terminal, image information through a camera when the vehicle speed decelerates to less than the reference speed, confirming, by the vehicle terminal, whether lane identification information is detected in the image information, and determining, by the vehicle terminal, whether the vehicle is located in the detection area of the actuated signal lane through the camera when the vehicle is stopped when the lane identification information is detected in the image information.

The method may further include outputting, by the vehicle terminal, guidance information informing that the vehicle is located in the detection area when the vehicle is located in the detection area as a determination result after determining whether the vehicle is located in the detection area of the actuated signal lane.

The method may further include, after determining whether the vehicle is located in the detection area of the actuated signal lane, determining, by the vehicle terminal, whether a vehicle detector installed on the actuated signal lane is in operation when the vehicle is not located in the detection area as a determination result, and outputting guidance information informing that the vehicle is located in the detection area when the vehicle detector is in operation.

The determining of whether the vehicle detector is operated may include detecting, by the vehicle terminal, whether the vehicle detector is in operated by detecting a change in inductance of the vehicle detector installed on the actuated signal lane through an inductance sensor.

The determining of the operation of the vehicle detector may include requesting, by the vehicle terminal, the signal change directly to a traffic signal controller configured to control an operation of the actuated signal light when the vehicle detector is not in operation.

The traffic signal controller may feedback signal change time information to the vehicle terminal when the vehicle detector detects that the vehicle is in the detection area.

The traffic signal controller may change a signal of the actuated signal light after a predetermined period of time elapses when the vehicle is detected in the detection area.

The vehicle terminal may obtain the actuated signal light information by using global positioning system (GPS) information and a precise map.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
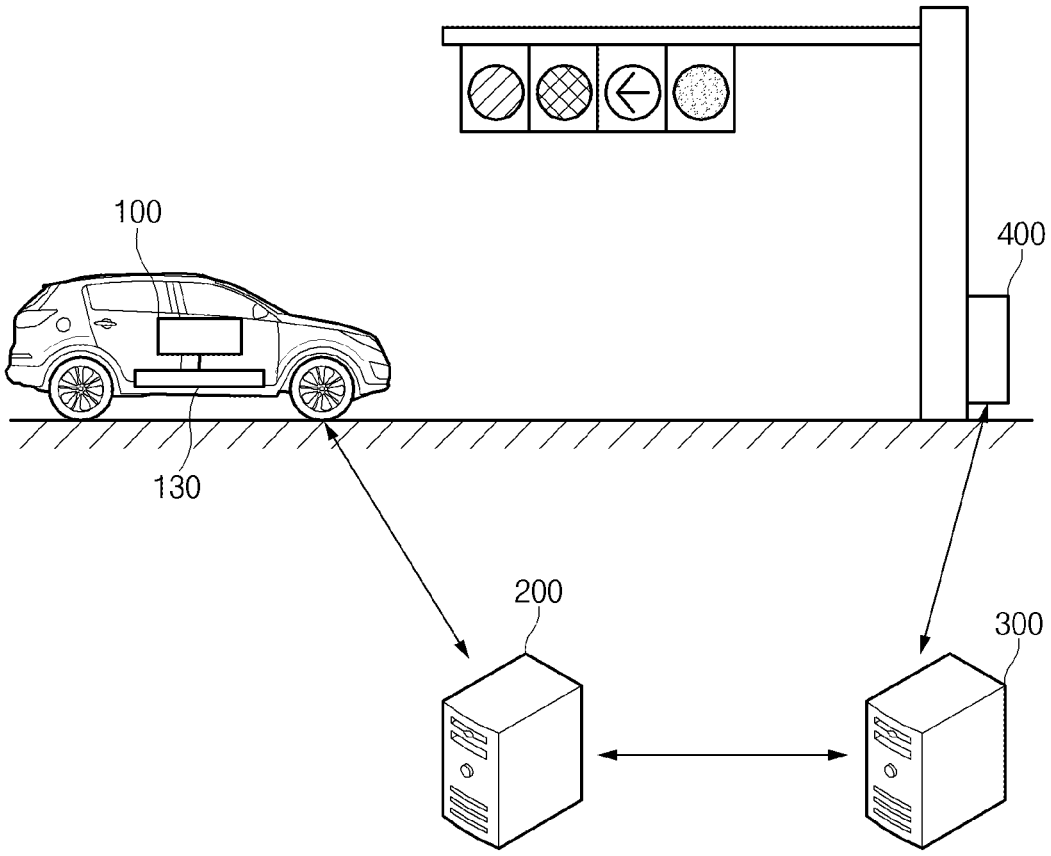
FIG. 1 is view illustrating a configuration of a vehicle actuated signal control system according to an embodiment of the present disclosure.

Hereinafter, exemplary embodiments of the present disclosure will be described in detail with reference to the accompanying drawings. In the drawings, the same reference numerals will be used throughout to designate the same or equivalent elements. In addition, a detailed description of well-known features or functions will be ruled out in order not to unnecessarily obscure the gist of the present disclosure.

In describing the components of the present disclosure, terms like first, second, "A", "B", (a), and (b) may be used. These terms are intended solely to distinguish one component from another, and the terms do not limit the nature, sequence or order of the constituent components. In addition, unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

FIG. 1 is view illustrating a configuration of a vehicle actuated signal control system according to an embodiment of the present disclosure.

Referring to FIG. 1, a vehicle actuated signal control system includes a vehicle terminal 100, a telematics server 200, a traffic light control server 300, and a traffic signal controller 400.

The vehicle terminal 100 confirms whether to use an actuated signal lane on the traveling path of a vehicle, and transmits information about an actuated signal light installed on the actuated signal lane to be used and the estimated arrival time.

Figure 2:
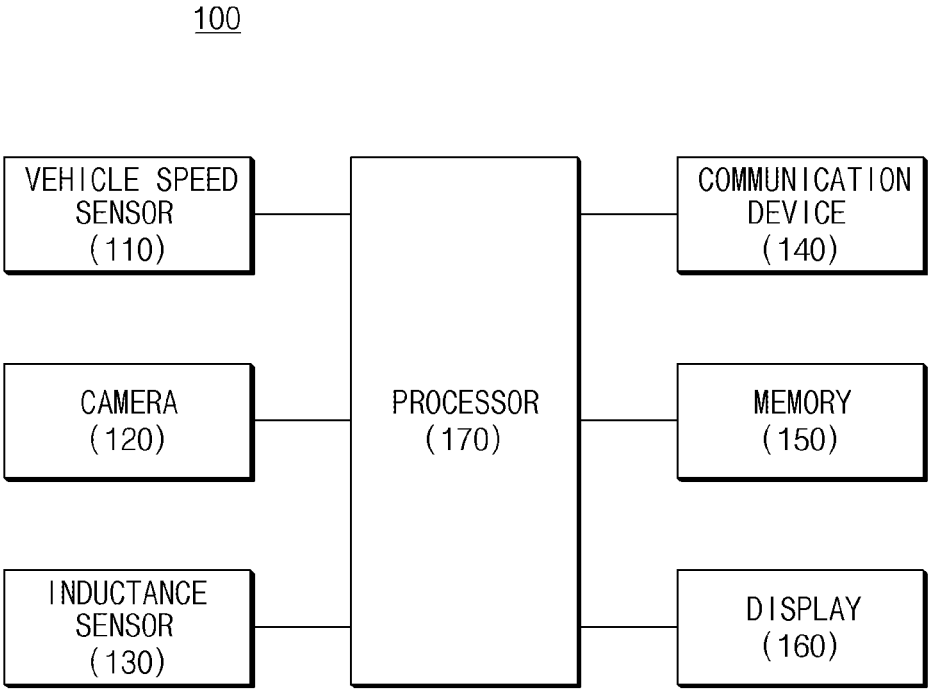
FIG. 2 is a block diagram of a vehicle terminal illustrated in FIG. 1.

Referring to FIG. 2, the vehicle terminal 100 includes a vehicle speed sensor 110, a camera 120, an inductance sensor 130, a communication device 140, a memory 150, a display 160, and a processor 170.

The vehicle speed sensor 110 is a sensor configured to detect a running speed of a vehicle, that is, a vehicle speed. The vehicle speed sensor 110 may be implemented with a reed switch type vehicle speed sensor, a photoelectric type vehicle speed sensor, an electronic type vehicle detector, or the like.

The camera 120 obtains image information of the surroundings of a vehicle. The cameras 120 may be installed at front, rear, and sides of the vehicle, respectively.

The camera 120 may be implemented with at least one of a charge coupled device (CCD) image sensor, a complementary metal oxide semiconductor (CMOS) image sensor, a charge priming device (CPD) image sensor, or a charge injection device (CID) image sensor, and the like. The camera 120 may include an image processor that performs image processing, such as noise elimination, color reproduction, file compression, image quality adjustment, saturation adjustment, or the like, on an image acquired through the image sensor.

The inductance sensor 130 senses a change in inductance of a loop coil, which is a vehicle detector installed on a lane. The inductance sensor 130 is installed on a lower end of a vehicle.

The communication device 140 performs communication with the telematics server 200, the traffic light control server 300, and/or the traffic signal controller 400.

The communication device 140 may use a wireless Internet technology such as wireless LAN (WiFi), wireless broadband (Wibro), and world interoperability for microwave access (Wimax), a short-range communication technology such as Bluetooth, near field communication (NFC), radio frequency identification (RFID), infrared data association (IrDA), or the like, and/or a mobile communication technology such as code division multiple access (CDMA), global system for mobile communication (GSM), a long term evolution (LTE), LTE-advanced, or the like.

The memory 150 stores precise map data, e.g., precise map information (hereinafter, referred to as "precise map"). The precise map includes lane information, road information, road facility information, and surrounding environment information. The lane information may include information such as identification information of the actuated signal lane, location information, a type including a left turn lane, a straight lane, a right turn lane, a U-turn lane, etc., and the like. The road facility information may include the identification information of the actuated signal light and the actuated signal light information such as the installation location.

The memory 150 may store software programmed to allow the processor 170 to perform a specified operation. The memory 150 may store input data and output data of the processor 170.

The memory 150 may be implemented with at least one of storage mediums (recording mediums) such as a flash memory, a hard disk, a secure digital (SD) card, a random access memory (RAM), a static random access memory (SRAM) (ROM), a programmable read only memory (PROM), an electrically erasable and programmable ROM (EEPROM), an erasable and programmable ROM (EPROM), a register, a removable disk, or web storage.

The display 160 outputs the progress state and result of the operation of the processor 170 as visual information. In this case, the visual information may include a text, an image, moving pictures, emoticons, and the like.

The display 160 may include at least one of a liquid crystal display (LCD), a thin film transistor liquid crystal display (TFT LCD), an organic light emitting diode (OLED) display, a flexible display, a three-dimensional (3D) display, a transparent display, a head-up display (HUD), a touch screen, or a cluster.

The display 160 may include an audio output module, such as a speaker, capable of outputting audio data. For example, the display 160 may display route guidance information and may output a voice signal (audio signal) through a speaker.

In addition, the display 160 may be implemented as a touch screen combined with a touch sensor, and may be used as an input device as well as an output device. The touch sensor may be a touch film or a touch pad.

The processor 170 controls the overall operation of the vehicle terminal 100. The processor 170 may be implemented with at least one of an application specific integrated circuit (ASIC), a digital signal processor (DSP), a programmable logic device (PLD), a field programmable gate array (FPGA), a central processing unit (CPU), a microcontroller, or a microprocessor.

The processor 170 executes a navigation function to set the travel route to a destination. The processor 170 guides the route along the set travel route. In this case, the processor 170 measures the current location of the vehicle through a global positioning system (GPS) receiver (not shown). The processor 170 maps the measured current location of the vehicle on the precise map and displays it on the display 160.

The processor 170 analyzes the traveling route to determine whether to use the actuated signal lane. The processor 170 confirms whether to use the actuated signal lane after the set time, e.g., 10 seconds to 15 seconds, on the travel route.

The processor 170 transmits the actuated signal light information and the estimated arrival time information to the telematics server 200 when the use of the actuated signal lane is scheduled after the set time. In this case, the processor 170 extracts the actuated signal light information matched to the actuated signal lane to be used from the precise map. In addition, the processor 170 obtains the estimated arrival time by calculating the time to be taken to reach the actuated signal lane to be used, based on the current location of the vehicle measured through the GPS receiver (not shown).

When it is impossible to reserve the signal change through the telematics server 200, the processor 170 recognizes the actuated signal lane and guides the driver. For example, when the vehicle terminal 100 is an unregistered terminal in the telematics server 200 or a communication level of the communication device 140 is lower than a reference level, the processor 170 performs the recognition of the actuated signal lane.

The processor 170 confirms whether the vehicle decelerates below a reference speed to recognize the actuated signal lane. In other words, the processor 170 confirms whether the vehicle speed detected through the vehicle speed sensor 110 is equal to or lower than the reference speed.

The processor 170 acquires a forward (traveling direction) image of the vehicle through the camera 120 when the vehicle speed is equal to or lower than the reference speed. The processor 170 analyzes the acquired forward image and confirms whether the forward image contains lane identification information indicating the actuated signal lane. The lane identification information is implemented with a text (e.g., 'actuation') and/or a symbol.

When the lane identification information is included in the forward image, the processor 170 confirms whether the vehicle is stopped through the vehicle speed sensor 110. When the vehicle stops, the processor 170 obtains an image of the surroundings of the vehicle through the camera 120, and confirms whether the vehicle is located within a vehicle detection area of the actuated signal lane. The processor 170 may determine whether the vehicle is located in the vehicle detection area by using a technique of estimating a location through known image analysis.

The processor 170 outputs to the display 160 a notification informing that the vehicle stops in the vehicle detection area when it is determined that the vehicle is located in the vehicle detection area. In this case, the processor 170 may output to the speaker a voice message of informing the driver that the vehicle stops in the vehicle detection area and may guide the driver.

When it is determined that the vehicle is not located in the vehicle detection area, the processor 170 detects whether the inductance of the loop coil installed in the actuated signal lane is changed through the inductance sensor 130. The processor 170 determines that the traffic signal controller 400 senses the vehicle through the loop coil, that is, the vehicle detector, when the change in inductance of the loop coil is detected. In other words, the processor 170 determines that the vehicle detector is in operation when there is a change in the inductance value of the loop coil. The processor 170 notifies the driver that the vehicle stops in the vehicle detection area when it is determined that the vehicle detector is in operation.

When the change in inductance of the loop coil is not detected, the processor 170 determines that the vehicle detector is not operated, and requests the traffic signal controller 400 to change the signal directly. In other words, when there is no change in the inductance value of the loop coil, the processor 170 transmits to the traffic signal controller 400 a signal indicating that the vehicle is stopped on the actuated signal lane.

In the above-described embodiment, the case where the processor 170 confirms whether the vehicle arrives at the actuated signal lane through the camera 120 is described, however, the embodiment is not limited thereto. It is possible to confirm whether the vehicle arrives at the actuated signal lane through interworking with the GPS receiver and the precise map. For example, the processor 170 may map the current location of the vehicle measured through the GPS receiver with the precise map to determine whether the vehicle arrives at the actuated signal lane.

In addition, the processor 170 transmits the actuated signal lane arrival signal to the traffic signal controller 400 when another vehicle is stopped in front of the vehicle or the vehicle is closed to a stop line when the vehicle reaches the actuated signal lane.

The processor 170 may receive a feedback signal provided by the traffic signal controller 400 and output the signal to the display 160 after transmitting the actuated signal lane arrival signal. For example, when the traffic signal controller 400 provides information about the signal change time point as the feedback signal, the processor 170 displays a guidance message, such as "Signal is changed after '0' seconds," on the display screen.

The telematics server 200 manages the vehicle terminals 100 registered in the telematics service. The telematics server 200 exchanges data with the vehicle terminal 100 through wireless communication. As wireless communication technology, wireless Internet technology and/or mobile communication technology may be used.

The telematics server 200 receives the actuated signal light information and the estimated arrival time information from the vehicle terminal 100. The telematics server 200 transmits the actuated signal light information and the estimated arrival time information provided from the vehicle terminal 100 to the traffic light control server 300 and requests a signal change reservation.

The telematics server 200 may perform wired and/or wireless communication with the traffic light control server 300. The wired communication technology may be implemented by a wired Internet technology such as a local area network (LAN), a wide area network (WAN), Ethernet, an integrated services digital network (ISDN), or the like.

The traffic light control server 300 manages and controls a general traffic light and an actuated signal light installed on a road side. When the signal change reservation request is received from the telematics server 200, the traffic light control server 300 sets the signal change reservation based on the actuated signal light information and the estimated arrival time information included in the received request message. The traffic light control server 300 transmits the set reservation information to the traffic signal controller 400 which controls the operation of the actuated signal light in which the signal change is reserved.

Although not shown, the telematics server 200 and the traffic light control server 300 may include communication modules, processors, and memories.

Figure 3:
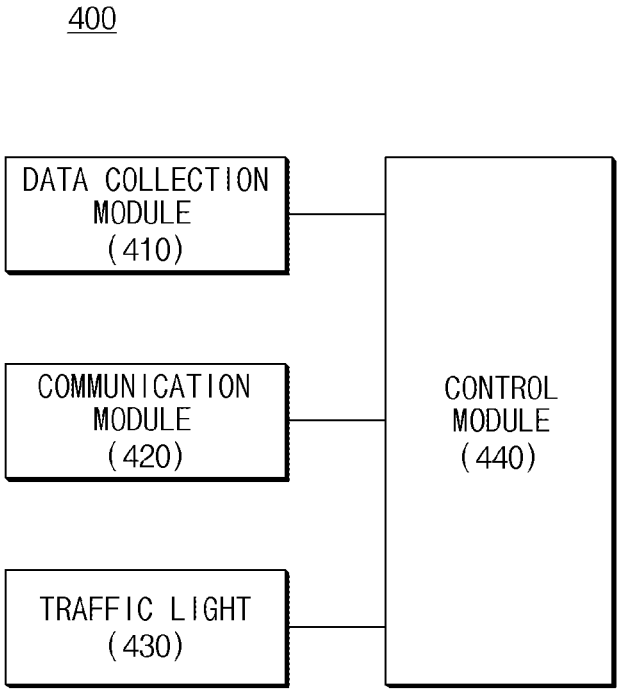
FIG. 3 is a block diagram of a traffic signal controller illustrated in FIG. 1.

The traffic signal controller 400 performs a function of controlling the operation of the actuated signal light. The traffic signal controller 400 changes the signal of the traffic light at the corresponding time (reserved time) based on the set reservation information. Referring to FIG. 3, the traffic signal controller 400 includes a data collection module 410, a communication module 420, a traffic light 430, and a control module 440.

The data collection module 410 confirms whether a vehicle exists in the vehicle detection area (hereinafter, referred to as a detection area) through the loop coil (vehicle detector) embedded in the actuated signal lane. In this case, the detection area is specified in advance based on the performance of the vehicle detector, that is, the detectable range. The detection area is marked in a rectangular shape on a road surface of the actuated signal lane.

The communication module 420 performs wireless communication with the vehicle terminal 100. The communication module 420 may directly receive the signal change request transmitted from the vehicle terminal 100.

In addition, the communication module 420 performs wired communication and/or wireless communication with the traffic light control server 300. The communication module 420 receives the reservation information transmitted from the traffic light control server 300.

The traffic light 430, which is a device for representing traffic signals such as straight (green), stop (red), caution (yellow), leftward (represented by a green arrow), and the like, includes light sources such as lamps, light emitting diodes, or the like.

The control module 440 which controls the overall operation of the traffic signal controller 400 may include a processor and a memory.

The control module 440 controls the lighting of the traffic light 430 according to a specified logic when a vehicle located in the detection area is detected by the data collection module 410. For example, the control module 440 changes the signal of the traffic light 430 to a left-turn signal after a predetermined period of time elapses when detecting the vehicle in the detection area of a left-turn actuated signal lane.

The control module 440 changes the signal of the traffic light 430 to a reservation signal at the reservation time based on the reservation information provided from the traffic light control server 300.

When the control module 440 receives the signal change request from the vehicle terminal 100, the control module 440 changes the signal of the traffic light 430 after a predetermined period of time elapses. In this case, the vehicle terminal 100 may transmit lane information on which the vehicle is located or information about a desired signal to be changed when a signal change request is made.

Figure 4:
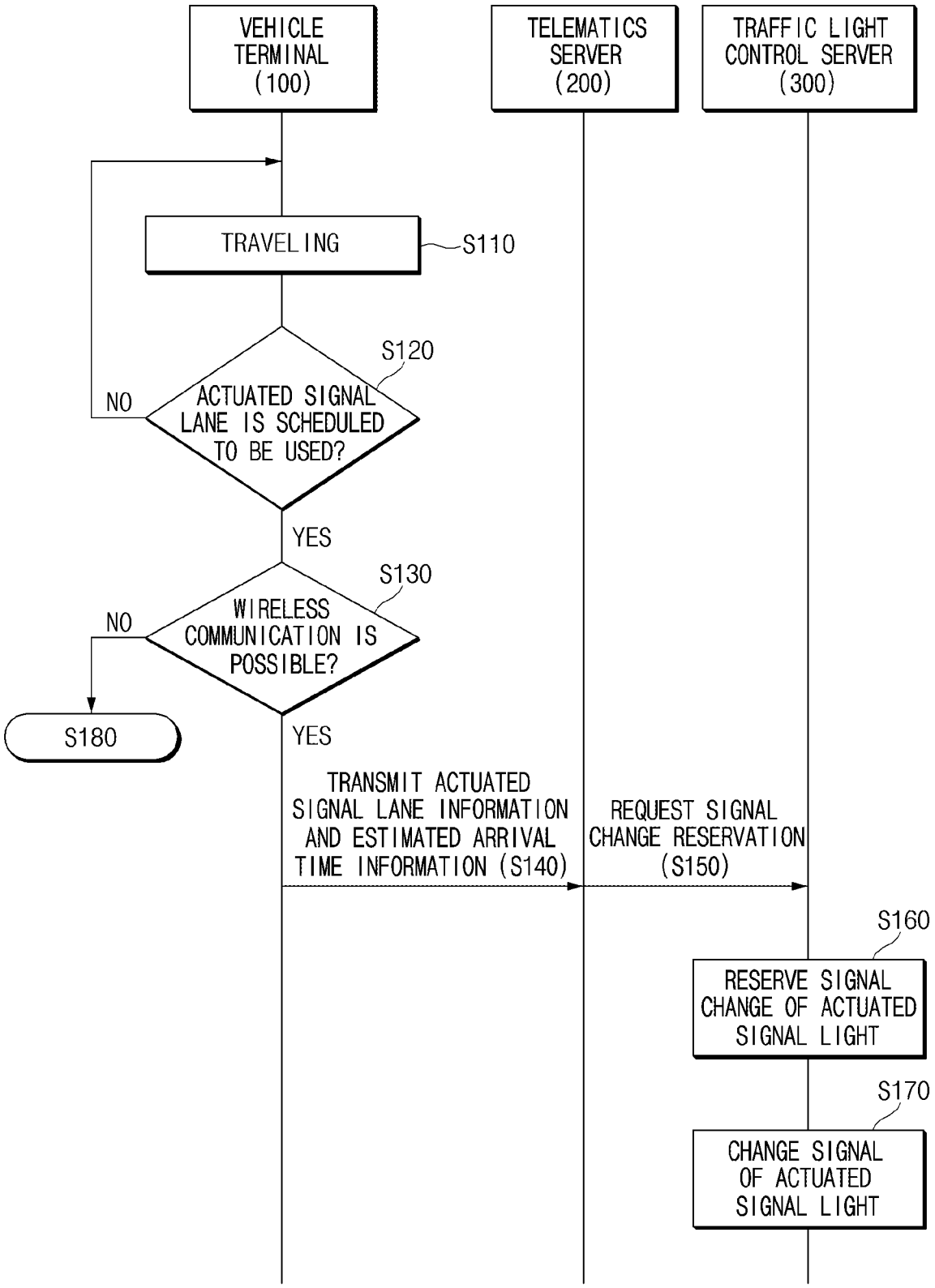
FIGS. 4 and 5 are flowcharts illustrating a method of controlling a vehicle actuated signal according to an embodiment of the present disclosure.
Figure 5:
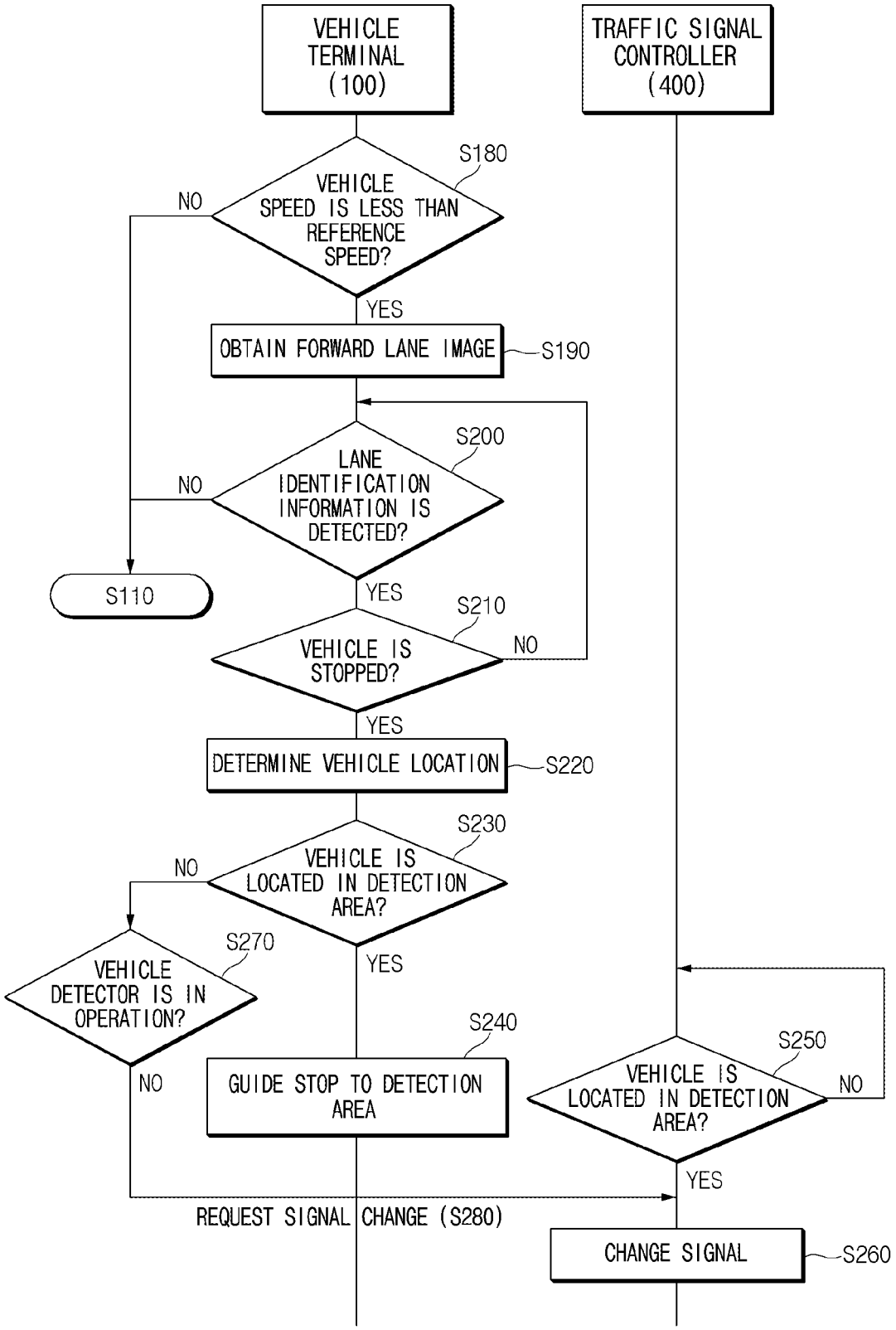

FIGS. 4 and 5 are flowcharts illustrating a method of controlling a vehicle actuated signal according to an embodiment of the present disclosure.

First, in operations S110 and S120, the vehicle terminal 100 confirms whether to use the actuated signal lane while traveling along a specific traveling route. Meanwhile, the vehicle terminal 100 confirms whether an actuated signal lane exists on the traveling route. In this case, the vehicle terminal 100 confirms whether to enter the actuated signal lane at a time when a specified time condition (e.g., within 10 seconds to 20 seconds) is met.

When the use of the actuated signal lane (hereinafter, referred to as an actuated lane) on the traveling route is scheduled, in operation S130, the vehicle terminal 100 confirms whether wireless communication with the telematics server 200 is possible.

In operation S140, the vehicle terminal 100 transmits information about the actuated signal light to be used and the estimated arrival time information when the wireless communication is possible, to the telematics server 200. The vehicle terminal 100 generates the actuated signal light information and the estimated arrival time information by using the GPS information received through the GPS receiver and the precise map.

In operation S150, when the telematics server 200 receives the actuated signal light information and the estimated arrival time information from the vehicle terminal 100, the telematics server 200 requests the traffic light control server 300 to make a signal change reservation.

When the telematics server 200 requests the signal change reservation, the telematics server 200 transmits the actuated signal light information and the estimated arrival time information together.

In operation S160, the traffic light control server 300 reserves a signal change time point of the actuated signal light in response to the request from the telematics server 200. The traffic light control server 300 reserves the signal change time point based on the actuated signal light information and the estimated arrival time information. Thereafter, in operation S170, the traffic light control server 300 changes the signal of the corresponding actuated signal light at the reserved time point. That is, the traffic light control server 300 instructs the traffic signal controller 400 of the actuated signal light of which the signal change is reserved to change the signal of the actuated signal light to the reserved traffic signal.

The traffic light control server 300 may transmit the set reservation information to the traffic signal controller 400 that controls the operation of the actuated signal light to change the signal. In this case, based on the reservation information, the traffic signal controller 400 changes the signal of the actuated signal light at the reserved signal change time point.

When it is determined in operation S130 that the wireless communication is not possible, in operation S180, the vehicle terminal 100 determines that the signal change reservation is not possible and determines whether the vehicle speed is less than the reference speed. The vehicle terminal 100 detects the vehicle speed through the vehicle speed sensor 110 and determines whether the detected vehicle speed is less than the reference speed.

In operation S190, when the vehicle speed is less than the reference speed, the vehicle terminal 100 obtains the forward lane image through the camera 120. The vehicle terminal 100 analyzes the obtained image and detects the lane identification information.

In operation S200, the vehicle terminal 100 confirms whether the lane identification information is detected from the obtained image. In other words, the vehicle terminal 100 confirms whether the obtained image includes the lane identification information. For example, the vehicle terminal 100 confirms whether there is a text 'actuation,' which is lane identification information, in the image photographed by the camera 120.

When the lane identification information is detected, in operation S210, the vehicle terminal 100 confirms whether the vehicle is stopped. The vehicle terminal 100 may determine whether the vehicle is stopped through the vehicle speed sensor 110.

In operation S220, when it is detected that the vehicle is stopped, the vehicle terminal 100 obtains an image of the surroundings of the vehicle through the camera 120 and analyzes the obtained image to determine whether the vehicle is located in the detection area of the actuated signal lane.

In operations S230 and S240, when it is determined that the vehicle is located in the detection area as the determination result, the vehicle terminal 100 informs the driver that the vehicle is stopped in the detection area. The driver confirms that the vehicle is stopped in the detection area through the guidance and waits until the signal change is implemented.

In operation S250, the traffic signal controller 400 confirms whether the vehicle is located in the detection area. The traffic signal controller 400 receives the signal output from the vehicle detector installed on the actuated signal lane through the data collection module 410. The traffic signal controller 400 determines whether the vehicle exists in the detection area based on the output signal of the vehicle detector.

In operation S260, the traffic signal controller 400 changes the signal of the traffic light 430 when the vehicle is located in the detection area.

When it is determined that the vehicle is not located in the detection area as the determination result, in operation S270, the vehicle terminal 100 confirms whether the vehicle detector installed on the actuated lane is operated. The vehicle terminal 100 confirms whether the inductance of the vehicle detector is changed through the inductance sensor 130 to determine whether the vehicle detector is operated. The vehicle terminal 100 determines that the vehicle detector is in operation when there is a change in the inductance value, and determines that the vehicle detector is not in operation when there is no change in the inductance value.

In operation S240, the vehicle terminal 100 informs the driver that the vehicle is stopped in the detection area when the vehicle detector is in operation.

The vehicle terminal 100 directly requests the traffic signal controller 400 to change the signal when the vehicle detector is not in operation. In this case, the vehicle terminal 100 transmits to the traffic signal controller 400 a notification of informing that the vehicle is located on the actuated signal lane or signal information about signal change desiring.

FIGS. 6A to 6D are views illustrating a process of controlling a vehicle actuated signal according to the present disclosure. The embodiment describes a case where signal reservation is not made.

Figure 6A:
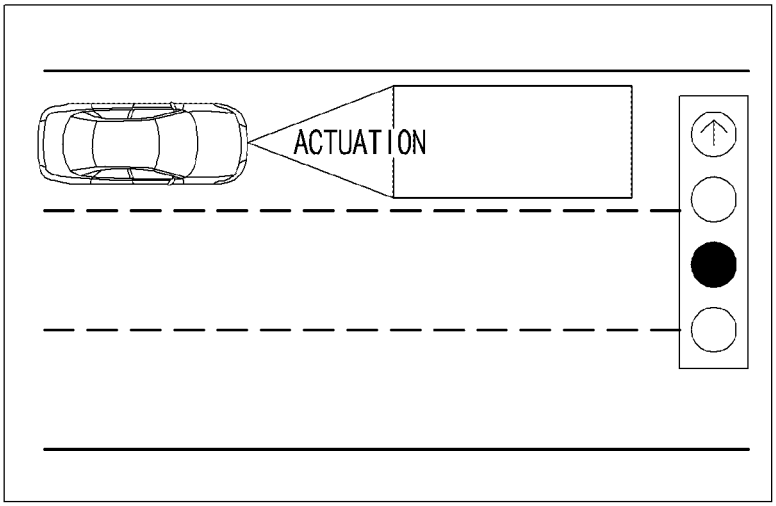
FIGS. 6A, 6B, 6C, and 6D are views illustrating a process of controlling a vehicle actuated signal according to an embodiment of the present disclosure.

Referring to FIG. 6A, when the vehicle decelerates to a speed lower than the reference speed, the vehicle terminal 100 detects the word of 'actuation,' which is lane identification information represented on the road surface through the camera 120. When the vehicle terminal 100 detects the lane identification information, the vehicle terminal 100 determines that the vehicle is located on the actuated lane.

Figure 6B:
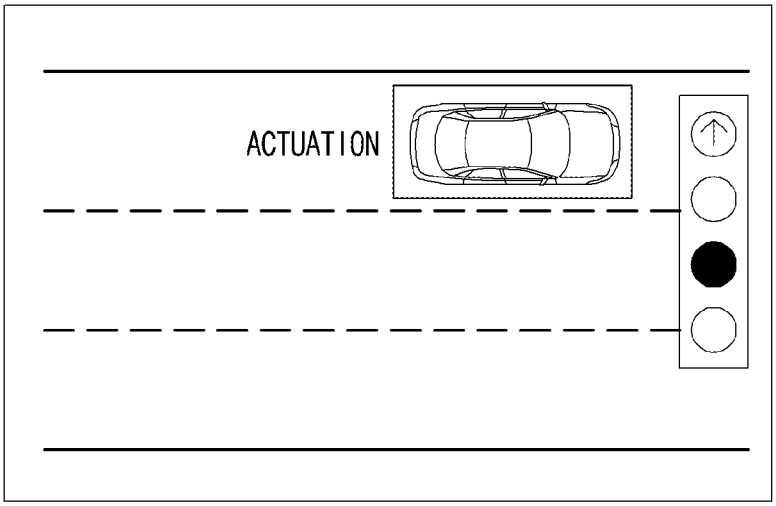

Thereafter, when the vehicle stops, the vehicle terminal 100 determines whether the vehicle is located in the detection area of the activated signal lane by using the camera 120. As shown in FIG. 6B, when the vehicle is located in the detection area, the vehicle terminal 100 informs the driver of it.

Figure 6C:
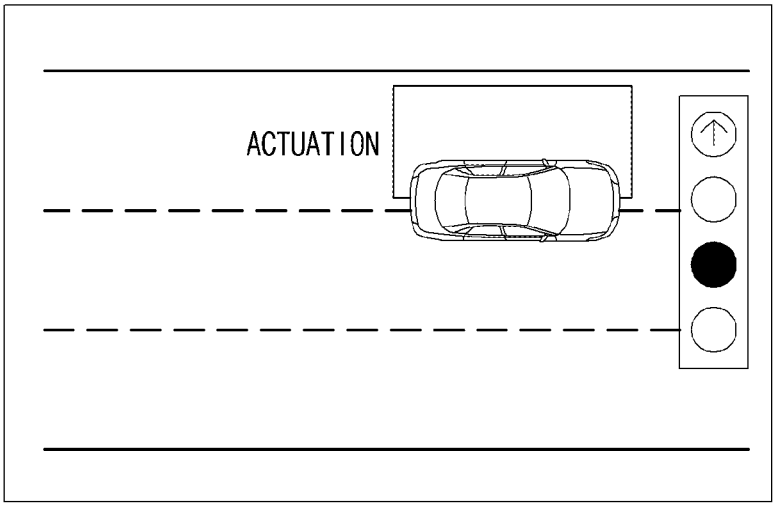
Figure 6D:
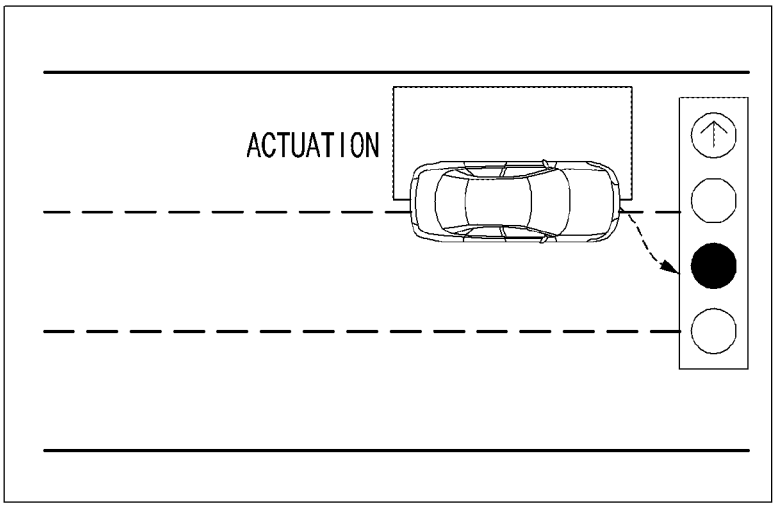

As shown in FIG. 6C, when the vehicle is stopped beyond the detection area, the vehicle terminal 100 uses the inductance sensor 130 to determine whether there is a change in inductance of a loop coil (vehicle detector) installed on the actuated signal lane.

When the inductance change of the loop coil is not detected so that it is determined that the loop coil is broken or the vehicle location is not properly sensed by the loop coil, the vehicle terminal 100 may directly request the traffic signal controller 400 to change the traffic signal by using wireless communication. The vehicle terminal 100 transmits to the traffic signal controller 400 the signal indicating that the vehicle is located on the actuated signal lane.

According to the present disclosures, because it is possible to reserve that the signal is changed immediately before the vehicle reaches the actuated signal lane when the vehicle is scheduled to pass through the actuated signal lane on the traveling route, the signal change may be proceeded without stopping the vehicle and the processing of sensing the vehicle in the vehicle detection area, so that it is possible to improve the driving convenience and the traffic flow.

In addition, according to the present disclosure, even when the actuated signal light cannot detect the vehicle, the vehicle may directly request the actuated signal light to change the signal, thereby immediately changing the signal.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A system for controlling a vehicle actuated signal, the system comprising:

a vehicle terminal configured to transmit actuated signal light information and estimated arrival time information when an actuated signal lane on a travel route is reserved to be used;

a telematics server configured to request a signal change reservation based on the actuated signal light information and the estimated arrival time information; and a traffic light control server configured to:

set the signal change reservation in response to a request of the telematics server; and control a signal of an actuated signal light based on set reservation information, wherein the vehicle terminal includes:

a processor configured to determine whether a vehicle is located in a detection area of the actuated signal lane through a vehicle speed sensor and a camera when the signal change reservation is not possible.

2. The system of claim 1, wherein the vehicle speed sensor measures a vehicle speed, and the camera obtains an image of vehicle surroundings.

3. The system of claim 2, wherein the vehicle terminal further includes an inductance sensor disposed at a lower end of the vehicle and configured to detect whether a vehicle detector installed on the actuated signal lane is in operation.

4. The system of claim 3, wherein the vehicle detector includes a loop coil to detect whether the vehicle is in the detection area.

5. The system of claim 4, wherein the inductance sensor is configured to detect a change in inductance of the loop coil.

6. The system of claim 5, wherein the processor is configured to determine that the vehicle is in the detection area by determining that the vehicle detector is in operation when the change in inductance of the loop coil is detected.

7. The system of claim 6, wherein the processor is further configured to directly request a traffic signal controller configured to control an operation of the actuated signal light to change a signal by determining that the vehicle detector is not in operation when the change in inductance of the loop coil is not detected.

8. The system of claim 7, wherein the traffic signal controller is further configured to feedback signal change time information to the vehicle terminal when the vehicle detector detects that the vehicle is in the detection area.

9. The system of claim 2, wherein the processor is configured to obtain the actuated signal light information by using global positioning system (GPS) information and a precise map.

10. A method of controlling a vehicle actuated signal, the method comprising steps of:

confirming, by a vehicle terminal, whether an actuated signal lane on a traveling route is reserved to be used, transmitting, by the vehicle terminal, actuated signal light information and estimated arrival time information to a telematics server when the actuated signal lane on the traveling route is reserved to be used;

requesting, by the telematics server, a traffic light control server to reserve a signal change based on the actuated signal light information and the estimated arrival time information; and reserving, by the traffic light control server, the signal change in response to the request of the telematics server, and changing a signal of an actuated signal light based on reservation information, wherein the step of transmitting includes a step of determining, by the vehicle terminal, whether a vehicle is located in a detection area of the actuated signal lane through a vehicle speed sensor and a camera when the signal change reservation is not possible.

11. The method of claim 10, wherein the step of confirming includes a step of:

confirming, by the vehicle terminal, whether the actuated signal lane is reserved to be used when a time condition set based on the traveling route is met.

12. The method of claim 10, further comprising, before the step of transmitting, a step of:

determining, by the vehicle terminal, a possibility of reserving the signal change by confirming whether wireless communication with the telematics server is possible.

13. The method of claim 12, wherein the step of determining the possibility of reserving the signal change includes steps of:

confirming, by the vehicle terminal, whether a vehicle speed decelerates to less than a reference speed when the signal change reservation is impossible;

obtaining, by the vehicle terminal, image information through a camera when the vehicle speed decelerates to less than the reference speed;

confirming, by the vehicle terminal, whether lane identification information is detected in the image information; and determining, by the vehicle terminal, whether the vehicle is located in a detection area of the actuated signal lane through the camera when the vehicle is stopped when the lane identification information is detected in the image information.

14. The method of claim 13, further comprising, after the step of determining whether the vehicle is located in the detection area, a step of:

outputting, by the vehicle terminal, guidance information informing that the vehicle is located in the detection area when the vehicle is located in the detection area as a determination result.

15. The method of claim 13, further comprising, after the step of determining whether the vehicle is located in the detection area, steps of:

determining, by the vehicle terminal, whether a vehicle detector installed on the actuated signal lane is in operation when the vehicle is not located in the detection area as a determination result; and outputting guidance information informing that the vehicle is located in the detection area when the vehicle detector is in operation.

16. The method of claim 15, wherein the step of determining whether the vehicle detector is in operation includes a step of:

detecting, by the vehicle terminal, whether the vehicle detector is in operated by detecting a change in inductance of the vehicle detector installed on the actuated signal lane through an inductance sensor.

17. The method of claim 15, wherein the step of determining whether the vehicle detector is in operation includes a step of:

requesting, by the vehicle terminal, the signal change directly to a traffic signal controller configured to control an operation of the actuated signal light when the vehicle detector is not in operation.

18. The method of claim 17, wherein the traffic signal controller is configured to feedback signal change time information to the vehicle terminal when the vehicle detector detects that the vehicle is in the detection area.

19. The method of claim 18, wherein the traffic signal controller is further configured to change a signal of the actuated signal light after a predetermined period of time elapses when the vehicle is detected in the detection area.

20. The method of claim 10, wherein the vehicle terminal is configured to obtain the actuated signal light information by using global positioning system (GPS) information and a precise map.

* * * * *